US005391400A

United States Patent [19]

Yang

[11] Patent Number: 5,391,400

[45] Date of Patent: Feb. 21, 1995

[54] AQUEOUS EMULSION CONTAINING AN OXIDATIVELY CROSSLINKED AMINOPOLYSILOXANE

[75] Inventor: Sue-Lein L. Yang, Thornwood, N.Y.

[73] Assignee: OSi Specialties, Inc., Danbury, Conn.

[21] Appl. No.: 991,384

[22] Filed: Dec. 16, 1992

[51] Int. Cl.[6] ..... B05D 5/08

[52] U.S. Cl. ..... 427/389.9; 427/385.5; 427/387; 427/389; 427/389.7; 427/393.4; 427/394; 252/8.6; 252/8.8; 8/115.51; 8/115.54; 8/115.6; 8/127.5; 8/181; 428/245; 428/260; 428/266; 428/288; 428/391

[58] Field of Search ..... 252/8.6, 8.8; 8/115.51, 8/115.54, 115.6, 127.5, 181; 427/389.9, 393.4, 387, 394, 385.5, 389, 389.7; 428/391, 245, 260, 266, 288

[56] References Cited

U.S. PATENT DOCUMENTS

| | | | |
|---|---|---|---|
| 3,033,815 | 5/1962 | Pike et al. | 528/38 |
| 3,146,250 | 8/1964 | Speier | 556/412 |
| 3,355,454 | 11/1967 | Klauke et al. | 544/194 |
| 3,953,651 | 4/1976 | Sone et al. | 428/391 |
| 4,137,179 | 1/1979 | Koerner et al. | 252/8.6 |
| 4,247,592 | 1/1981 | Kalinowski | 428/266 |
| 4,419,391 | 12/1983 | Tanaka et al. | 427/387 |
| 4,541,936 | 9/1985 | Ona et al. | 252/8.6 |
| 4,725,635 | 2/1988 | Okada et al. | 524/114 |
| 4,770,873 | 9/1988 | Wolfram et al. | 424/71 |
| 4,810,253 | 3/1989 | Kasprzak et al. | 8/137 |
| 4,923,623 | 5/1990 | Coffindaffer | 252/8.8 |
| 4,961,753 | 10/1990 | Donkers et al. | 252/8.8 |
| 5,000,861 | 3/1991 | Yang | 252/8.6 |
| 5,232,611 | 8/1993 | Ohashi et al. | 252/8.8 |
| 5,302,657 | 4/1994 | Huhn et al. | 252/8.8 |

FOREIGN PATENT DOCUMENTS

| | | |
|---|---|---|
| 870649 | 5/1971 | Canada . |
| 2422613 | 5/1973 | Germany . |

*Primary Examiner*—Anthony Green
*Attorney, Agent, or Firm*—Andrew S. Reiskind

[57] ABSTRACT

An aqueous emulsion composition containing an aminopolysiloxane, a water-soluble oxidant such as hydrogen peroxide and its salts, water and optionally a hydroxy-terminated polysiloxane, which emulsion imparts slickness and durability to a fibrous substrate without releasing volatile organic compounds and method of use is provided.

9 Claims, No Drawings

AQUEOUS EMULSION CONTAINING AN OXIDATIVELY CROSSLINKED AMINOPOLYSILOXANE

BACKGROUND OF THE INVENTION

1. Field of the Invention

The present invention relates to an emulsion containing a crosslinked aminopolysiloxane which when applied to a fibrous substrate imparts such properties as slickness, softness, compression resistance, and water repellency without releasing volatile organic compounds. More particularly, the present invention relates to a stable aqueous emulsion comprising an aminopolysiloxane, a water soluble oxidant, and optionally a hydroxy-terminated polysiloxane, which emulsion when applied to a fibrous substrate imparts slickness without releasing a volatile organic alcohol such as methanol.

2. Prior Art

Many emulsions containing organomodified polysiloxanes which impart slickness, softness, and water repellency to textiles are commercially available or are described in the literature. In general, aminopolysiloxanes are used as softeners for a variety of textiles. Aminopolysiloxanes are also used with a silane to provide slickness and durability to a textile, especially to polyester fiberfill. When an aminopolysiloxane and a silane are used in textile finishing processes, volatile organic compounds such as organic alcohols, for example, methanol and the like are released. Increasingly there is a need to prevent the release of such volatile organic compounds to the surrounding environment.

SUMMARY OF THE INVENTION

Accordingly, the present invention provides an aqueous emulsion composition and a method of using such composition which imparts slickness to a fibrous substrate without releasing a volatile organic compound. The emulsion composition is a mixture of water, an aminopolysiloxane, a water soluble oxidant, and optionally a hydroxy-terminated polysiloxane.

DETAILED DESCRIPTION OF THE INVENTION

The present invention is a stable aqueous emulsion composition comprising water, an aminopolysiloxane, a water soluble oxidant, and optionally a hydroxy-terminated polysiloxane and a method to incorporate slickness to a fibrous substrate without the release of volatile organic alcohols.

Aminopolysiloxane

In its broadest aspect, the aminopolysiloxane of the present invention has at least two amino or substituted amino groups linked to a siloxy unit through an organic bridge that is bonded to the silicon by a carbon-to-silicon bond. The aminopolysiloxanes are linear, branched or cyclic structures. They are characterized by a viscosity ranging from about 1 to 20,000 centipoises measured at 25° C. Preferably, the viscosity is about 10 to 10,000 at 25° C. The aminopolysiloxanes that can be employed in the present invention have an amine content ranging from about 0.05% to 3%, by weight, preferably from about 0.1% to 2% by weight as measured as $NH_2$ (formula weight=16). The preferred aminopolysiloxane is a linear structure possessing triorganosilyl endblocking illustrated by Formula I:

$$R_3SiO(R_2SiO)_a(RQSiO)_bSiR_3 \quad (I)$$

wherein:

R is hydroxyl or a monovalent hydrocarbon group including alkyl, aryl and aralkyl groups having no more than 10 carbon atoms. The R groups may be the same as or different from one another, and are illustrated by OH, methyl, ethyl, butyl, hexyl, phenyl and benzyl. Of these, the lower alkyls ($C_1$–$C_4$) are preferred. Most preferably, R is methyl.

In Formula I, a ranges in value from about 0 to 2,000, preferably a ranges in value from about 0 to 1,000, and most preferably a ranges in value from about 0 to 500; and b ranges in value from about 1 to 100, preferably b ranges in value from about 1 to 50, most preferably b ranges in value from about 1 to 20.

The Q group of Formula I comprises one or two amino groups, and may also contain hydroxyl substitution. More particularly, Q has the general Formula II:

$$-(X)_d(X')_e(Y)_f-N(R^1)(R^2) \quad (II)$$

wherein:

X is a linear or branched alkylene group having one to eight carbon atoms such as, for example, methylene, ethylene, propylene or hexylene, and preferably has two to five carbon atoms;

X' is a divalent organic radical including alkylene of one to four carbon atoms (such as, for example, methylene, ethylene and propylene) or phenylene or preferably oxypropylene (i.e., $-C_3H_{60}-$, the oxygen of which is bonded to a carbon atom of the Y group);

Y is a hydroxyl-substituted acyclic alkylene group of two to eight carbon atoms and is illustrated by 2-hydroxypropylene, i.e., $-CH_2CH(OH)CH_2-$, or Y is a hydroxyl-substituted cyclic alkylene group having no more than eight carbon atoms as illustrated by 2-hydroxycyclohexylene, i.e.,

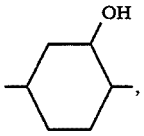

of which the cyclic groups having three to six carbon atoms are preferred;

d, e, and f are zero or one provided the sum of d+e is one and the sum of e+f is zero or two; and $R^1$ and $R^2$ are independently hydrogen or an alkyl having from one to eight carbon atoms of which lower alkyls ($C_1$–$C_4$) are preferred, or a hydroxyalkyl group having from two to four carbon atoms, or an alkyleneamino group.

The alkyleneamino group within the scope of $R^1$ and $R^2$ of Formula II in turn has the following Formula III:

$$-C_gH_{2g}N(R^3)(R^4) \quad (III)$$

wherein:

$R^3$ and $R^4$ are independently, alkyl or hydrogen as defined above with reference to $R^1$ and $R_2$; and g is an integer from two to eight, preferably no more than four.

From the above, it is evident that the amino-containing group, Q, can be a mono- or diamino group of the following types where the specific groups shown for X, X', Y and $R^1$–$R^4$ and the value of g are selected for illustrative purposes only:

$—C_3H_6NH_2$
$—C_3H_6N(C_2H_5)_2$
$—CH_2CH_2C(CH_3)_2NH_2$
$—C_3H_6N(CH_2CH_2OH)_2$
$—C_3H_6N(CH_3)CH_2CH_2NH_2$
$—C_3H_6NHCH_2CH_2NH_2$
$—C_3H_6O—CH_2CH(OH)CH_2NH_2$
$—C_3H_6—N(CH_2CH_2OH)(CH_2CH_2NH_2)$
$—C_3H_6O—CH_2CH(OH)CH_2N(H)CH_2CH_2NH_2$

Aminopolysiloxanes employed in the present invention are readily commercially available and can be obtained from Union Carbide Chemicals and Plastics Company, Inc. Alternatively, aminopolysiloxanes used in the present invention can be prepared by the procedures disclosed in U.S. Pat. Nos. 3,033,815; 3,146,250; 3,355,454 and 4,247,592.

Water Soluble Oxidant

Oxidants which are water soluble, and, thus, compatible with the emulsion containing the aminopolysiloxane can be employed in the present invention. Preferably, the water soluble oxidant is selected from the group consisting of (i) hydrogen peroxide and its salts; (ii) an alkali metal perborate; (iii) a hydroperoxidate; and (iv) mixtures thereof. Suitable hydrogen peroxide salts include, for example, ammonium peroxides and alkali metal salts of hydrogen peroxide such as, for example, sodium peroxide and potassium peroxide. Illustrative alkali metal perborates can include, for example, sodium perborate and potassium perborate. By "hydroperoxidate" is meant a hydrogen peroxide addition compound, that is, a compound carrying hydrogen peroxide of crystallization (W. C. Schumb, C. N. Satterfield, and R. L. Wentworth, *Hydrogen Peroxide,* Reinhold Publishing Corporation, New York: 1955, p. 26). Hydroperoxidates which can be employed as water soluble oxidants include, for example, sodium carbonate peroxide, sodium sulfate peroxide, ammonium sulfate peroxide, sodium phosphate peroxide and urea peroxide. Most preferably hydrogen peroxide and sodium perborate are employed in the present invention. It is to be understood that other alkali metals, such as cesium, can be employed in the water soluble oxidant, however, they are generally less available and/or more expensive, and, hence, are less frequently employed in the emulsion of the present invention.

Hydroxy-terminated Polysiloxane

The hydroxy-terminated polysiloxane employed in the present invention is represented by:

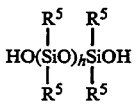

wherein each $R^5$ is the same or different and is a monovalent hydrocarbon selected from the group consisting of an alkyl having 1 to 10 carbon atoms, an aryl such as phenyl or tolyl, an aralkyl such as benxyl, and a group wherein one or more hydrogen atoms of the alkyl, aryl, and aralkyl is substituted with a group selected from the group consisting of halogen, cyano, sulfohydryl, hydroxy; and h has a value from about 1 to 2,000, preferably h has a value from about 5 to 800; and the viscosity of the hydroxy-terminated polysiloxane ranges from 10 to 10,000 centipoise at 25° C. Hydroxy-terminated polysiloxanes are readily commercially available and can be obtained from Union Carbide Chemicals and Plastics Company Inc.

Emulsion Preparation

The preparation of an aqueous emulsion containing the aminopolysiloxane and the oxidant is accomplished by adding the water soluble oxidant, preferably an aqueous solution of the water soluble oxidant, to an emulsion of the aminopolysiloxane with mixing or blending.

Typical emulsifiers which can be used in the preparation of the aminopolysiloxane emulsion include nonionic, cationic and anionic surfactants. Examples of nonionic surfactants include polyoxyethylene alkyl ether, polyoxyethylene alkylphenol ether, polyoxyethylene alkyl ester, polyoxyethylene sorbitan alkyl ester, polyalkylene glycol, and polyalkylene glycol modified polysiloxanes. Examples of cationic surfactants include quaternery ammonium salts such as alkyltrimethylammonium hydroxide, dialkyldimethylammonium hydroxide, and trialkyl hydroxyethylammonium methosulfate. Examples of anionic surfactants include sulfate and sulfonate salts such as sodium alkylsulfate, alkanolammonium alkylsulfate, sodium alkylarylsulfonate and alkanolammonium alkylarylsulfonate.

When a hydroxy-terminated polysiloxane is incorporated into the emulsion, the emulsion is prepared by mixing or blending the aminopolysiloxane and the hydroxy-terminated polysiloxane prior to emulsifying by means of the addition of water and optionally one or more surfactants. Alternatively, both the aminopolysiloxane and the hydroxy-terminated polysiloxane can each be formulated into an emulsion by the addition of water and optionally one or more surfactants and the two separate emulsions can be mixed or blended together. For this latter preparation, emulsions of aminopolysiloxane and emulsions of hydroxy-terminated polysiloxanes are readily available from Union Carbide Chemicals and Plastics Company, Inc. The oxidant is added to the emulsion containing the aminopolysiloxane and the hydroxy-terminated polysiloxane. Preferably, the oxidant is added as an aqueous solution.

The final aqueous emulsion containing the aminopolysiloxane, the oxidant and/or optionally the hydroxy-polysiloxane thus prepared is allowed to react at room temperature or an elevated temperature below 90° C. before application to textiles. Preferably the reaction conditions are in the range of room temperature to 75° C. for 3 to 24 hours. Most preferably, the reaction conditions are between 40° C. to 65° for 4 to 12 hours.

The amount of aminopolysiloxane in the total emulsion ranges from about 0.1 to 60 parts by weight based upon 100 parts of the total emulsion, and preferably the amount ranges from about 1 to 40 parts by weight based upon 100 parts of the total emulsion.

At least about 0.05% to about 1.5% amine content based upon the total weight of the total emulsion should be present. Preferably, the amine content ranges from about 0.05 to 1, and most preferably it ranges from about 0.1 to 0.5.

The amount of the water-soluble oxidant in the total emulsion ranges from about 0.05 to 5 parts by weight based upon 100 parts of the total emulsion, and preferably the amount ranges from about 0.1 to 3 parts by weight based upon 100 parts of the total emulsion.

When employed, the amount of hydroxy-terminated polysiloxane in the total emulsion ranges from about 0.1 to 50 parts by weight based upon 100 parts of the total emulsion, and preferably the amount ranges from about 1 to 40 parts by weight based upon 100 parts of the total emulsion.

Preferably, in the total emulsion the amount of aminopolysiloxane, water soluble oxidant, and optionally hydroxy-terminated polysiloxane ranges from about 0.1 to 70 parts by weight of the emulsion; and, most preferably, the amount of aminopolysiloxane, water soluble oxidant, and optionally the hydroxy-terminated polysiloxane ranges from about 1 to 50 parts by weight of the emulsion with the remainder of the emulsion being composed primarily of water.

Other additives optionally can be included in the emulsion. Such additives can include, for example, a biocide such as, for example, Parasepts® (available from Kalama Chemical, Inc.) or Phenonip® (available from NIPA Laboratories, Inc.), dyes, and brighteners.

Additives which will change the pH of the emulsion below 6 should be avoided. Preferably, the pH of the aqueous emulsion containing the aminopolysiloxane, the oxidant and/or optionally the hydroxy-terminated polysiloxane is in the range of 6 to 11, and most preferably, in the range of 7 to 10.

Emulsion Application to Textile

The emulsion of the present invention can be diluted with water to a desired solids level and applied onto a fiber substrate using any suitable means, such as, for example, spraying, dipping or kiss roll application. Indeed, it will be more common to prepare the emulsion at a higher solids content in order to reduce shipping and/or handling costs and then dilute the formulation with water just prior to use. After the textile is dried either at room temperature or by heating, it is cured at a temperature less than the melting or decomposition temperature of the textile. Heating can be accomplished by any suitable means known in the art, however, preferably heating is accomplished by passing the textile through a hot air oven. The textile so treated has properties such as slickness, softness, compression resistance, and water repellency with good durability.

While not wishing to be bound by theory, it is believed that in-situ generation of a silanol species occurs in the aminopolysiloxane emulsion and the final emulsion of the present invention. According to Si-29 Nuclear Magnetic Resonance Spectroscopic analysis, it has been discovered that even though the starting aminopolysiloxane contains only trace levels of silanols, the final emulsion prepared from the aminopolysiloxane and the silanol groups in the hydroxy-terminated polysiloxane showed a substantial increase in silanol functionally. It is believed that reaction occurs between the silanol groups generated from the aminopolysiloxane and the silanol groups in the hydroxy-terminated polysiloxane. The reaction takes place partially in the final emulsion but completely during the curing process.

The fibrous substrate employed in the present invention is exemplified by natural fibers such as cotton, flax, silk, and wool; synthetic fibers such as polyester, polyamide, polyacrylonitrile, polyethylene, polypropylene, and polyurethane; and inorganic fibers such as glass fiber and carbon fiber and mixtures and blends thereof. Preferably the fibrous substrate employed in the present invention is a synthetic fiber. Most preferably the fibrous substrate employed in the present invention is a synthetic polyester fiber.

The following examples are set forth for illustrative purposes only and are not to be construed as unduly limiting of the present invention. All parts and percentages are by weight unless otherwise specified.

DESCRIPTION OF TEST METHODS

Emulsion Stability

For an emulsion to be considered stable, it must retain its integrity after (1) heating at 50° C. for at least three days and (2) three cycles of a freeze-thaw test. For (1) above, the emulsion is heated at 50° C. in a constant temperature oven. Most of the emulsions of the present invention exhibited stability at 50° C. far beyond three days. The freeze-thaw test, (2) above, was conducted by freezing a sample emulsion in a −15° C. freezer followed by slow thawing at room temperature for three consecutive cycles.

Fiber Slickness

A DuPont® unslickened fiberfill product, i.e., Hollofil® T-808, was used for the evaluation of slickness imparted by the application of the silicone emulsion described in this invention. A piece of Hollofil® T-808 was soaked in the diluted emulsion of interest and then passed through a roller to obtain 150% wet pick-up, i.e. the weight of the finished fiberfill was 2.5 times of the weight of the unfinished fiberfill. After drying at room temperature, the finished sample was cured at 170° C. for 5 min.

The slickness of fiberfill was measured by staple pad friction which was calculated as the force required to pull a certain weight over a fiberfill staple pad. The staple pad friction was defined as the ratio of the force over the applied weight. A ten pound weight was used in the friction measurement of this invention. A lower friction value was indicative of better slickness. The precision of the method was ±10%. A friction table was mounted on the crosshead of an Instron® tensile tester. The surface of the friction table and the base of the weight were covered with Emery® Paper #320 from the 3M Company so that there was little relative movement between the fiberfill staple pad and the weight or the staple pad and the table. Essentially all the movement was a result of fibers sliding across each other. The ten pound weight was attached to a stainless steel wire connected to a pulley mounted at the base of the Instron® tester. The other end of the stainless steel wire was connected to the loadcell of the Instron tester.

Durability of Slickness

Durability of slickness was determined by (1) laundering and/or (2) solvent extractions. The durability of slickness was determined by repeated laundering which was performed according to American Association of Textile Chemists and Colorists (AATCC) standard procedures. Staple pad friction was measured after 5 cycles of washing at 120° C. (67° C.) with 1 cup of AATCC standard detergent 124, rinsing at 105° F. and drying at 140 to 160° F.

Solvent extraction was performed using a 30 fold excess perchloroethylene over the fiberfill sample and mixing the sample and perchloroethylene for 2 hours using a roll mill. Staple pad friction was measured after solvent extraction.

Example 1

A commercially available emulsion (Emulsion I) from Union Carbide containing 40% of an aminopolysiloxane of the following formula:

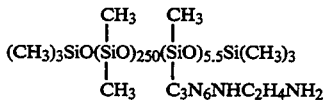

was mixed with a 30% aqueous hydrogen peroxide solution so that the final hydrogen peroxide levels were 0.5%, 1% and 2% based on the weight of the emulsion. Each of the emulsions was heated at 65° C. for four hours. These heated emulsions are stable at 50° C. for 3 days and after 3 cycles of the freeze-thaw test. After heating, one part of isopropanol was added to two parts of emulsion to break the emulsion. The viscosity of the silicone phase was measured using a Brookfield viscometer. Table I shows the viscosities of the silicone phases of the samples. Crosslinking is demonstrated by the viscosity increase and/or the gel formation in the samples containing hydrogen peroxide.

TABLE I

| Run No. | % Hydrogen Peroxide in Emulsion I | Viscosity of Silicone Phase |
|---|---|---|
| A | Control (no hydrogen peroxide) | 440 centipoises |
| 1 | 0.5% hydrogen peroxide | 1,240 centipoises |
| 2 | 1% hydrogen peroxide | gelled (>100,000 centipoises; insoluble in isopropanol) |
| 3 | 2% hydrogen peroxide | gelled (>100,000 centipoises; insoluble in isopropanol) |

COMPARATIVE EXAMPLE A

Two aliquots of emulsion I were acidified to pH 5 and pH 3, respectively, using concentrated hydrochloric acid. To 96.7 parts of each of the acidic emulsions, 3.3 parts of a 30% hydrogen peroxide solution were added so that the final hydrogen peroxide concentration was 1%. The acidic emulsions (Runs 4 and 6), as well as the ones containing 1% hydrogen peroxide (Runs 5 and 7), were heated at 65° C. for 4 hours. All emulsions broke into 2 layers after heating. One part of isopropanol was mixed with two parts of sample to isolate the silicone phase. The silicone phases of all samples were viscous (>20,000 centipoises), due to the formation of quaternary ammonium species by the addition of hydrochloric acid. However, as shown in Table II, the silicone phases are soluble in isopropanol.

This example showed that the acidified emulsions (Runs 4 and 6) are not stable compared to the stable emulsions of this invention, (Runs 1 to 3 of Example 1). This example further showed that hydrogen peroxide does not cause formation of silicone gel, which is insoluble in isopropanol, in acidified emulsions.

TABLE II

| Run No. | pH and % Hydrogen Peroxide in Emulsion I | Silicone Phase |
|---|---|---|
| 4 | pH 3, no hydrogen peroxide | viscous, soluble in isopropanol |
| 5 | pH 3, 1% hydrogen peroxide | viscous, soluble in isopropanol |
| 6 | pH 5, no hydrogen peroxide | viscous, soluble in isopropanol |
| 7 | pH 5, 1% hydrogen peroxide | viscous, soluble in isopropanol |

EXAMPLE 2

Forty-nine parts of Emulsion I as described in Example 1 was mixed with one part of the 30% hydrogen peroxide solution so that the total hydrogen peroxide level is 0.6% based on the total weight of the emulsion. The mixture (Emulsion II) was heated at 65° C. for 5.5 hours and used to finish an unfinished fiberfill sample. The staple pad friction was measured before and after laundering and solvent extraction. The values of the staple pad friction are listed in Table III. The slickness imparted by the silicone finish (Run 8) is shown by a much lower friction value than the control (Run B). The durability of the slickness is shown by maintaining low friction values after solvent extraction (Run 9) and laundering (Run 10).

TABLE III

| Run No. | Polyester Fiberfill Sample | Staple Pad Friction |
|---|---|---|
| B | Hollofil T-808 | 0.50 |
| 8 | Hollofil T-808 with 0.65% silicone finish (Emulsion II) | 0.19 |
| 9 | Run #8 after solvent extraction | 0.19 |
| 10 | Run #8 after laundering | 0.22 |

EXAMPLE 3

Treatment Using a Different Water Soluble Oxidant

Four parts of a commercially available emulsion (Emulsion III) from Union Carbide containing 40% of an aminopolysiloxane of the following formula:

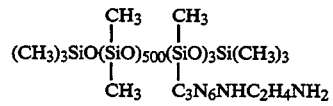

was mixed with one part of a 10% aqueous solution of sodium perborate (Run 11). The mixture, as well as a Control C which did not contain sodium perborate, were heated at 65° C. for 4 hours. After heating, one part of isopropanol was added to two parts of the samples to break the emulsion. From the viscosity measurements of the silicone phases noted in Table IV, it is evident that crosslinking of the aminopolysiloxane occurred by the addition of sodium perborate.

TABLE IV

| Run No. | Viscosity of Silicone Phase |
|---|---|
| C | 2,100 centipoises |
| 11 | gelled (>100,000 centipoises) |

EXAMPLE 4

Emulsion Containing Aminopolysiloxane, Hydroxy-Terminated Polysiloxane and Hydrogen Peroxide An emulsion (Emulsion IV) was prepared by blending 20 parts of the aminopolysiloxane of Example 3 and 20 parts of a hydroxy-terminated polysiloxane having a viscosity of 1,000 centistokes at 25° C. Emulsification was accomplished by using 2.4 parts of a polyoxyethylene alkyl ether (Tergitol® 15-S-15), 1.6 parts of another polyoxyethylene alkyl ether (Tergitol® 15-S-3) and 56 parts of water.

Emulsion IV was mixed with a 30% aqueous hydrogen peroxide solution so that the final hydrogen peroxide levels are 0.3% and 0.6% based on the weight of the emulsion. The mixtures (Runs 12 and 13, respectively), as well as Control D (Emulsion IV with no hydrogen peroxide), were heated at 65° C. for 4 hours. After the emulsions were cooled to room temperature, one part of isopropanol was added to two parts of emulsion to break the emulsion. The viscosity of the silicone phase was measured using a Brookfield viscometer. Table V shows the viscosity of the silicone phases of the samples. Crosslinking is demonstrated by the viscosity increase in the samples containing hydrogen peroxide.

TABLE V

| Run No. | Viscosity of Silicone Phase |
|---|---|
| D | 1,500 centipoises |
| 12 | 4,000 centipoises |
| 13 | 6,800 centipoises |

What is claimed is:

1. A method for imparting slickness and durability to a textile fibrous substrate without releasing volatile organic compounds, which method comprises contacting the fibrous substrate with an aqueous emulsion comprising:

(a) an aminopolysiloxane having an amine content ranging from about 0.05% to 3.0% by weight, present at 0.1 to 60 parts per hundred of the total emulsion and having the formula $R_3SiO(R_2SiO)_a(RQSiO)_bSiR_3$ wherein: each R is the same or different and is a hydroxyl or a monovalent hydrocarbon group having 1 to 10 carbon atoms; a is from 1 to 5000; b is a number from 1 to 100; Q has the formula: $—(X)_d(X')_e(Y)_f—N(R^1)(R^2)$, wherein X is a linear or branched alkylene group having 1 to 8 carbon atoms; X' is a divalent organic radical; Y is selected from the group consisting of a hydroxyl-substituted acyclic alkylene group 2 to 8 carbon atoms and a hydroxyl-substituted cyclic alkylene group having up to 8 carbon atoms; d, e and f are zero or one provided the sum of d+e is one and the of sum e+f is zero or two; and $R^1$ and $R^2$ are independently selected from the group consisting of hydrogen, an alkyl group having 1 to 8 carbon atoms, a hydroxyalkyl group having 2 to 4 atoms, and an alkyleneamino group having the formula: $—C_gH_{2g}N(R^3)(R^4)$, wherein $R^3$ and $R^4$ are independently either hydrogen or an alkyl group having 1 to 8 carbon atoms and g is an integer from 2 to 8;

(b) a water soluble oxidant present at 0.05 to 5 parts per hundred of the total emulsion; and (c) water.

2. A method according to claim 1 wherein the substrate is selected from the group consisting of (a) flax; (b) silk; (c) wool; and (d) cotton; (e) polyester; (f) polyamide; (g) polyacrylonitrile; (h) polyethylene; i) polypropylene; j) polyurethane; (k) glass; (l) carbon; and (m) blends thereof.

3. The method according to claim 1 wherein the water soluble oxidant is selected from the group consisting of (I) hydrogen peroxide and its salts; (ii) an alkali metal perborate; (iii) a hydroperoxidate; and (iv) mixtures thereof.

4. The method according to claim 1 wherein the amine content ranges from 0.05% to 1.5% by weight of the total emulsion.

5. A method according to claim 1 wherein the aminopolysiloxane is:
$(CH_3)_3SiO((CH_3)_2SiO)_{250}((CH_3)(C_3H_6NHC_2H_4NH_2)SiO)_{5.5}Si(CH_3)_3$.

6. A method according to claim 1 wherein the aminopolysiloxane is:
$(CH_3)_3SiO((CH_3)_2SiO)_{500}((CH_3)(C_3H_6NHC_2H_4NH_2)SiO)_3Si(CH_3)_3$.

7. A method according to claim 1 wherein the emulsion additionally comprises a hydroxy-terminated polysiloxane.

8. A method according to claim 7 wherein the hydroxy-terminated polysiloxane is $HO((R^5)_2SiO)_h(R^5)_2SiOH$, wherein each $R^5$ is a monovalent hydrocarbon selected from the group consisting of: an alkyl having 1 to 10 carbon atoms, an aryl, an aralkyl, and a group wherein one or more hydrogen atoms of the alkyl, aryl, and aralkyl is substituted with a sulfohydryl group, and a hydroxy; h has a value from about 1 to 2,000; and the viscosity of the hydroxy-terminated polysiloxane is from 10 to 10,000 centipoise at 25° C.

9. A fibrous substrate treated with the aqueous emulsion composition of claim 1.

* * * * *